US009138849B2

(12) United States Patent
McLaughlin et al.

(10) Patent No.: US 9,138,849 B2
(45) Date of Patent: Sep. 22, 2015

(54) SHARPENING APPARATUS

(75) Inventors: Leonard McLaughlin, Doret (GB); Oliver Nathaniel Ambrose Price, London (GB); Peter David Cauwood, Cambridge (GB)

(73) Assignee: ELIXAIR INTERNATIONAL LIMITED, Broadmayne, Dorset (GB)

( * ) Notice: Subject to any disclaimer, the term of this patent is extended or adjusted under 35 U.S.C. 154(b) by 142 days.

(21) Appl. No.: 13/812,148

(22) PCT Filed: Jul. 25, 2011

(86) PCT No.: PCT/GB2011/051408

§ 371 (c)(1), (2), (4) Date: May 29, 2013

(87) PCT Pub. No.: WO2012/013966

PCT Pub. Date: Feb. 2, 2012

(65) Prior Publication Data

US 2013/0237125 A1 Sep. 12, 2013

(30) Foreign Application Priority Data

Jul. 30, 2010 (GB) ..... 1012823.9

(51) Int. Cl.

| | |
|---|---|
| ***B24B 3/00*** | (2006.01) |
| ***B24B 3/36*** | (2006.01) |
| ***B24B 3/38*** | (2006.01) |
| ***B24B 23/02*** | (2006.01) |

(52) U.S. Cl.

CPC ... *B24B 3/36* (2013.01); *B24B 3/00* (2013.01); *B24B 3/38* (2013.01); *B24B 23/02* (2013.01)

(58) Field of Classification Search

CPC ..... B24B 3/38; B24B 3/48; B24B 3/52; B24B 3/54

USPC ..... 451/5, 6, 8, 11, 231, 234, 241, 349, 358

See application file for complete search history.

(56) References Cited

U.S. PATENT DOCUMENTS 2,800,755 A * 7/1957 Perra ..... 451/415
3,698,140 A * 10/1972 Steadman ..... 451/438

(Continued)

OTHER PUBLICATIONS

International Search Report (ISR) published Feb. 2, 2012 for International Patent Application No. PCT/GB2011/051408 filed on Jul. 25, 2011.

(Continued)

*Primary Examiner* — Maurina Rachuba

(74) *Attorney, Agent, or Firm* — Fleit Gibbons Gutman Bongini & Bianco PL; Paul D. Bianco

(57) ABSTRACT

A portable sharpening apparatus is described. The sharpening apparatus includes a body portion and a cavity formed in the body portion for receiving an object to be sharpened. A rotatable abrasive drum capable of sharpening and having an axis of rotation is provided and the abrasive drum is located in the body portion. The apparatus further comprises a motor arranged to drive the abrasive drum and a mouth communicating with the abrasive drum and arranged in the body portion so as to direct an object to be sharpened towards the abrasive drum, wherein the mouth has a supporting means for locating an object to be sharpened at the abrasive drum, the supporting means being such that, when in use, an object to be sharpened is orientated along an axis substantially perpendicular to the axis of rotation of the abrasive drum.

9 Claims, 8 Drawing Sheets

(56) References Cited

U.S. PATENT DOCUMENTS

| | | | | |
|---|---|---|---|---|
| 3,742,652 | A * | 7/1973 | Enders | 451/180 |
| 3,800,480 | A * | 4/1974 | Keating | 451/421 |
| 3,841,030 | A * | 10/1974 | Laszlo | 451/358 |
| 4,279,554 | A * | 7/1981 | Seidenfaden | 409/180 |
| 4,744,178 | A * | 5/1988 | Afshar | 451/438 |
| 5,251,407 | A * | 10/1993 | Afshar | 451/349 |
| 5,676,591 | A * | 10/1997 | Huang | 451/359 |
| 5,951,385 | A * | 9/1999 | Newhouse et al. | 451/358 |
| 6,106,372 | A * | 8/2000 | Clark | 451/56 |
| 6,846,231 | B2 * | 1/2005 | Oles et al. | 451/415 |
| 8,801,501 | B2 * | 8/2014 | Worthington | 451/45 |
| 2006/0040587 | A1 * | 2/2006 | Eriksson | 451/5 |
| 2013/0237134 | A1 * | 9/2013 | Worthington | 451/367 |

OTHER PUBLICATIONS

Written Opinion (WO) published Jan. 30, 2013 for International Patent Application No. PCT/GB2011/051408 filed on Jul. 25, 2011.

International Preliminary Report on Patentability (IPRP) published Feb. 5, 2013 for International Patent Application No. PCT/GB2011/051408 filed on Jul. 25, 2011.

* cited by examiner

SHARPENING APPARATUS

FIELD OF THE INVENTION

The present invention relates to a sharpening apparatus, particularly, but not exclusively, to a portable sharpening apparatus suitable for sharpening and resharpening tools such as scrapers that may have become blunt through use.

BACKGROUND OF THE INVENTION

A tool such as a scraper or a chisel is known and comprises a blunt end suitable for holding or gripping by a user and a sharp end for scraping or other abrasive use. The sharp end is located remote from the user end. The sharp end is known to comprise a profiled or bevelled end face or include another type of surface finish to form a suitably sharp cutting and/or scraping surface for use by the user. An example of such a tool is an "Elixair™ SkyScraper". The Elixair™ SkyScraper is illustrated in FIG. 1*a*, showing scraper 1 comprising a thicker user end 2, suitable for gripping in order to operate the scraper, and a thinner tool end 3. The scrapper has a dimension L along a longitudinal axis, a dimension, or breath, b along an axis substantially perpendicular to longitudinal axis L and a dimension w along a further axis substantially perpendicular to longitudinal axis L and longitudinal axis b. The ends 2, 3 and the tool are manufactured together from strong plastic such as polypropylene or the polyether ether ketone material known as PEEK or ULTEM 1000 material. The Elixair™ SkyScraper tool illustrated in FIG. 1*a* is suitable for removing both cured and partially cured polysulphides, including PRC, from surfaces during manufacturing and servicing functions executed within the aviation industry. In particular, the scraper 1 can be used for removing and scraping back dried adhesive during aircraft wing manufacture. Other coatings or surface finishes can also be removed with The Elixair™ SkyScraper tool.

Repeated use and scraping with the tool end 3 results in the blunting of end 3. The tool end 3 becomes blunt through use. The tool becomes less useful with blunting and must either be discarded and recycled or resharpened, as appropriate, in order to prolong the useful life of the tool.

Existing sharpening systems are known. Current systems however are available only for use in a controlled environment, for example mounted to a bench or to a wall. An "in situ" or permanently mounted sharpening apparatus rely on user control during the sharpening step or insertion of the tool into a sharpening section or device of the apparatus in order to control the action of the abrasive grinding drum or diamond dresser on the end of the tool to be sharpened. The user can control the abutment of the end of the tool to be sharpened with the sharpening device. In addition, a guide or support may be preset at the sharpening apparatus in order to assist the user in the sharpening operation.

The known sharpening systems and apparatus rely on a stable usage and sharpening situation and mounting and require that a user is in the vicinity of the sharpening apparatus when a tool becomes blunt and requires sharpening.

SUMMARY OF THE INVENTION

It is desirable to provide an improved apparatus and method for sharpening a surface of a tool such as a tool that requires sharpening or has become blunt through use, which provides an alternate to the aforementioned devices.

According to a first aspect, the invention comprises a portable sharpening apparatus comprising:

a body portion;

a cavity formed in the body portion for receiving an object having a face to be sharpened;

a surfacing member capable of sharpening and having an axis of operation, the surfacing member located in the body portion;

a motor arranged to drive the surfacing member at the axis of operation; and a mouth communicating with the surfacing member and arranged in the body portion so as to direct an object to be sharpened towards the surfacing member, wherein the mouth comprises a supporting means for locating an object to be sharpened at the surfacing member. In an embodiment the supporting means comprises one or more lateral support members for guiding the object to be sharpened such that, when in use, an object to be sharpened is orientated with a face to be sharpened parallel to the axis of operation of the surfacing member, and the surfacing member may comprise an abrasive drum having an axis of rotation. In an embodiment the supporting means comprises one or more guiding fingers such that, when in use, an object to be sharpened is orientated along an axis substantially perpendicular to the axis of rotation of the abrasive drum.

According to a second aspect, the invention comprises a portable sharpening apparatus comprising:

a body portion;

a cavity formed in the body portion for receiving an object to be sharpened;

a rotatable abrasive drum capable of sharpening and having an axis of rotation, the abrasive drum located in the body portion;

a motor arranged to drive the abrasive drum; and a mouth communicating with the abrasive drum and arranged in the body portion so as to direct an object to be sharpened towards the abrasive drum, wherein the mouth has a supporting means for locating an object to be sharpened at the abrasive drum, the supporting means being such that, when in use, an object to be sharpened is orientated along an axis substantially perpendicular to the axis of rotation of the abrasive drum.

The portable nature of the sharpening apparatus allows a user greater freedom and flexibility in sharpening a tool. A user does not need to be located in proximity to a sharpening apparatus mounting position in order to easily sharpen a tool and obtain access to the sharpening apparatus. For example, in a large hanger or factory building there may be one or more sharpening apparatus stations located at one or more, or a series of, permanent, fixed positions. A user on finding a tool has become blunted through use will need to cease work at his or her current location and seek out a sharpening station. A portable sharpening apparatus can therefore increase operator efficiency within the workplace.

In an embodiment the mouth has an entrance delimited by a front edge, a rear edge, and an upper edge and a lower edge, the edges being substantially straight such that when in use an object to be sharpened is introduced to the mouth, the distance between the object to be sharpened and the upper and lower edges of the mouth is substantially uniform.

The orientation of the tool to be sharpened against the abrasive drum will result in an effective sharpening operation. The supporting means and surfaces provide guidance and alignment and keep the axis of the scraper perpendicular to the rotational axis of the drum when a scraper tool to be sharpened and inserted into the mouth is narrower than the mouth aperture. It can be said that supports are provided to set and fix the tool in the correct location for sharpening and thus control the angular position of the tool in relation to the abrasive drum. Material is scraped from the abrasive drum and the edge of the object to be sharpened during the sharpening operation.

In an embodiment the mouth comprises a front wall, a rear wall, an upper wall and a lower wall, the walls being substantially straight such that when in use an object to be sharpened is located within the mouth, the distance between the object to be sharpened and the upper and lower walls of the mouth is substantially uniform.

The supporting means ensure that the tool to be sharpened is held in the correct orientation, angle and attitude to the abrasive drum. The control of angular position of the tool in relation to the drum (i.e. perpendicular to the axis of rotation of the drum) does not limit the freedom of the operator to position the tool at a location within the mouth. The supporting means is such that the tool may be positioned at an alternative location on the abrasive drum but will be maintained at an orientation along an axis that is substantially perpendicular to the axis of rotation of the abrasive drum. This means that the distance between the upper and lower surfaces of the tool (in use in the sharpening operation) will be maintained in parallel, and may be at an equidistant location, from the upper and lower walls of the mouth.

In an embodiment the mouth comprises a front wall, a rear wall, an upper wall and a lower wall, the walls being substantially straight such that when in use an object to be sharpened is located within the mouth, the distance between the object to be sharpened and the upper wall of the mouth at the entrance to the mouth and the distance between the object to be sharpened and the upper wall of the mouth at the abrasive drum is substantially uniform, and the distance between the object to be sharpened and the lower wall of the mouth at the entrance to the mouth and the distance between the object to be sharpened and the lower wall of the mouth at the abrasive drum is substantially uniform.

In an arrangement the apparatus further comprises an access gate located upstream of the abrasive drum and arranged in communication with the motor such that, when in use, the abrasive drum is driven by the motor in response to a displacement of the access gate by the introduction of an object to be sharpened into the mouth.

This means the abrasive drum of the portable sharpening apparatus may be driven by the motor in response to a displacement of the access gate, further providing an electrical efficiency measure and a safety feature.

This means that the abrasive drum is caused to be driven by the motor when a tool to be sharpened is inserted into the sharpening apparatus. The design thus extends the life of the sharpening drum and the sharpening apparatus. In an embodiment the displacement of the access gate is arranged to engage a switch, the switch being capable of activating the motor to drive the abrasive drum. The switch comprises activation means arranged to activate the motor to drive the abrasive drum in response to the presence in the cavity of an object to be sharpened and further comprises deactivation means arranged to deactivate the motor in response to the absence in the cavity of an object to be sharpened. Also the abrasive drum may be driven by the motor in response to an input from one or more sensors mounted on or within the body portion. The sensors may detect the location of the scraper within the mouth. It is possible to arrange that the motor be driven only when the tool is close to the abrasive drum and thus use the minimum energy and power for the sharpening process. The drive means may be powered by a portable battery pack in view of the portable nature of the apparatus so conserving power would be important in this situation. The battery pack may comprise a set of batteries requiring recharging or replacing when exhausted, alternatively there may be a battery pack removable for charging in a charger or charging point adapted for that purpose.

In an embodiment, the body portion is dimensioned and arranged to include orientating means adapted to prevent incorrect location of an object to be sharpened in the mouth. This means that a user is discouraged from placing a tool to be sharpened into the mouth in such a way that either the tool or sharpener or the abrasive drum could be damaged. For example, if a user inserted a part of the tool such as thicker or harder, user end into the mouth excess material may be removed from the drum. This would reduce the abrasive property and lifetime of the drum and could render the user end of the tool unsuitable for gripping and use by a user.

A one-way fitting or insertion means ("pokyoke") may be used such as a physical constraint or barrier that would prevent errors or mistakes in the sharpening process and with the equipment such that literally incorrect operation of the apparatus cannot be performed and could not be allowed.

The portable sharpening apparatus may comprise a sealable opening in the casing arranged in communication with the cavity. The sealable opening of the preferred embodiment comprises a slideable cover arranged to cover the opening and biased across the opening. The slideable cover may include resilient means for biasing the cover into a closed position. The cover avoids dust and debris entering the apparatus and damaging or disabling the abrasive drum or the blunted or just-sharpened end of the object to be sharpened.

In an embodiment, the supporting means comprises at least one tooth arranged in communication with the mouth and the supporting means includes resilient means for biasing the tooth towards an inner portion of the mouth, such that in use the at least one tooth is urged away from the inner portion of the mouth by introduction in the mouth of an object to be sharpened. In this way the object to be sharpened is gripped and held securely by the supporting means prior to and during the sharpening operation. The supporting means may comprise a plurality of teeth located through at least one of the group of; a front wall, a rear wall, an upper wall and a lower wall of the mouth. The orientation of the teeth at the object to be sharpened benefits from location within a wall of the mouth.

In use in an embodiment the at least one tooth or teeth is urged away from a first position in the inner portion of the mouth towards a second position in the cavity outside the walls of the mouth by introduction in the mouth of an object to be sharpened. In an embodiment the tooth or teeth in the second position in the cavity are arranged to engage a switch, the switch being capable of activating the motor to drive the abrasive drum.

BRIEF DESCRIPTION OF THE DRAWINGS

The invention will now be described in more detail, by way of example only, with reference to the accompanying drawings, in which.

DETAILED DESCRIPTION OF THE INVENTION

Figure 1A:
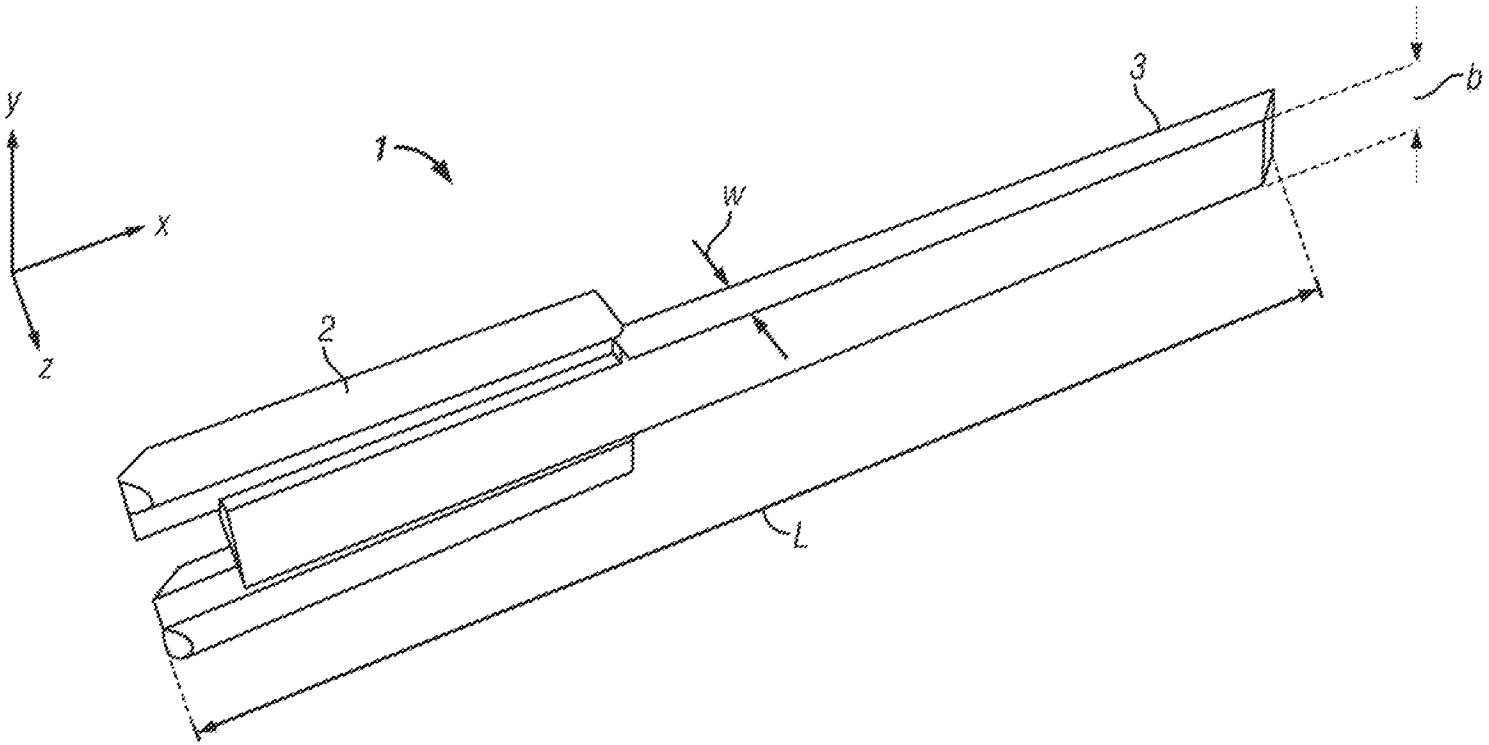
FIG. 1*a* is a perspective view of a tool to be sharpened.

The portable sharpening apparatus and a tool to be sharpened will now be described with reference to FIGS. 1*a*, 1*b*, 2 and 3. The tool comprises a sharp end 3, of a material capable of being sharpened. The other end 2 of the tool comprises features suitable for holding and gripping by a user.

The object to be sharpened, in this case sharpening tool 1, is inserted into the portable sharpening apparatus 4. The portable sharpening apparatus comprises a body 10 arranged to surround the sharpening mechanism and operational features. In the embodiment illustrated the body 10 comprises a generally rectangular shape, other shapes may be envisaged. A plurality of slots 9 are provided in the body 10 for ventilation and air cooling during operation. A hatch 11 is incorporated into the upper, outermost portion of the body 10 and includes a portion capable of sliding to reveal an opening 12 through which the tool to be sharpened may be inserted. The hatch 11 may be held in an open position, to reveal the opening 12, against the force of a resilient biasing means (not shown) by a suitable button or catch arrangement as will be apparent to one of skill in the art.

Figure 1B:
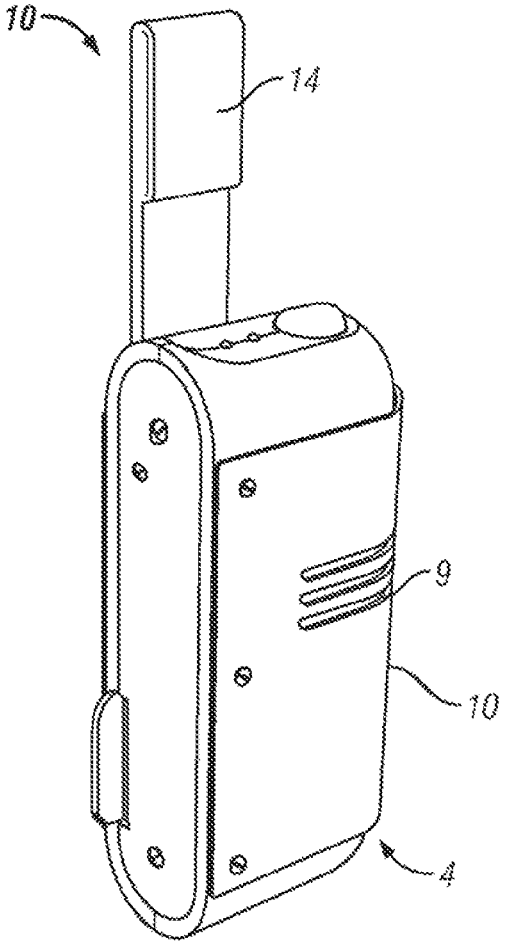
FIG. 1*b* is perspective view of a tool to be sharpened inserted into the portable sharpening apparatus of the present invention.
Figure 2:
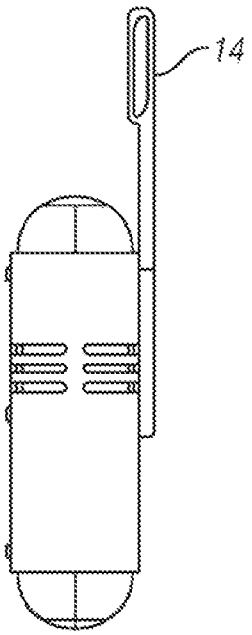
FIG. 2 is a side view of the portable sharpening apparatus of the present invention.

In FIG. 1*b* the sharpener is shown partially obscured and at a position inserted within the sharpener ready to be sharpened. The tool is inserted and presented along an axis parallel to the axis of the longest dimension of the body 10 of the portable sharpening apparatus. FIG. 2 shows the feature of a belt loop or belt hook 14 and this provides a mechanism for a user to carry the portable sharpening apparatus in a convenient manner and in a location close to the body for when the user wishes to execute the sharpening function and operate the sharpening apparatus. The user may hang the sharpening apparatus from a belt or strap and in that way the apparatus will be to hand when required.

Figure 3:
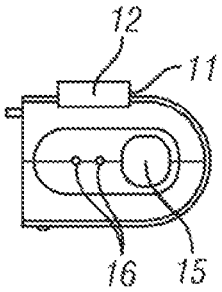
FIG. 3 is a plan view of the portable sharpening apparatus of the present invention.

FIG. 3 illustrates the sharpening apparatus in an overhead view including opening 12 and the on (standby)/off button 15 described in further detail below. The body 10 comprises status lights 16, such as LEDs, in addition to on/off function button 15. The indicator lights are provided to indicate the status of the apparatus and power source, for example no lights are shown when the apparatus is off, a first light displaying a first colour could indicate that the sharpener is available (powered) and ready to use, the display of a second colour could indicate that the sharpener apparatus is on charge, a third colour display could show a fully charged status and the display of one or more further colours at a second indicator light could indicate a fault or malfunction.

Figure 4:
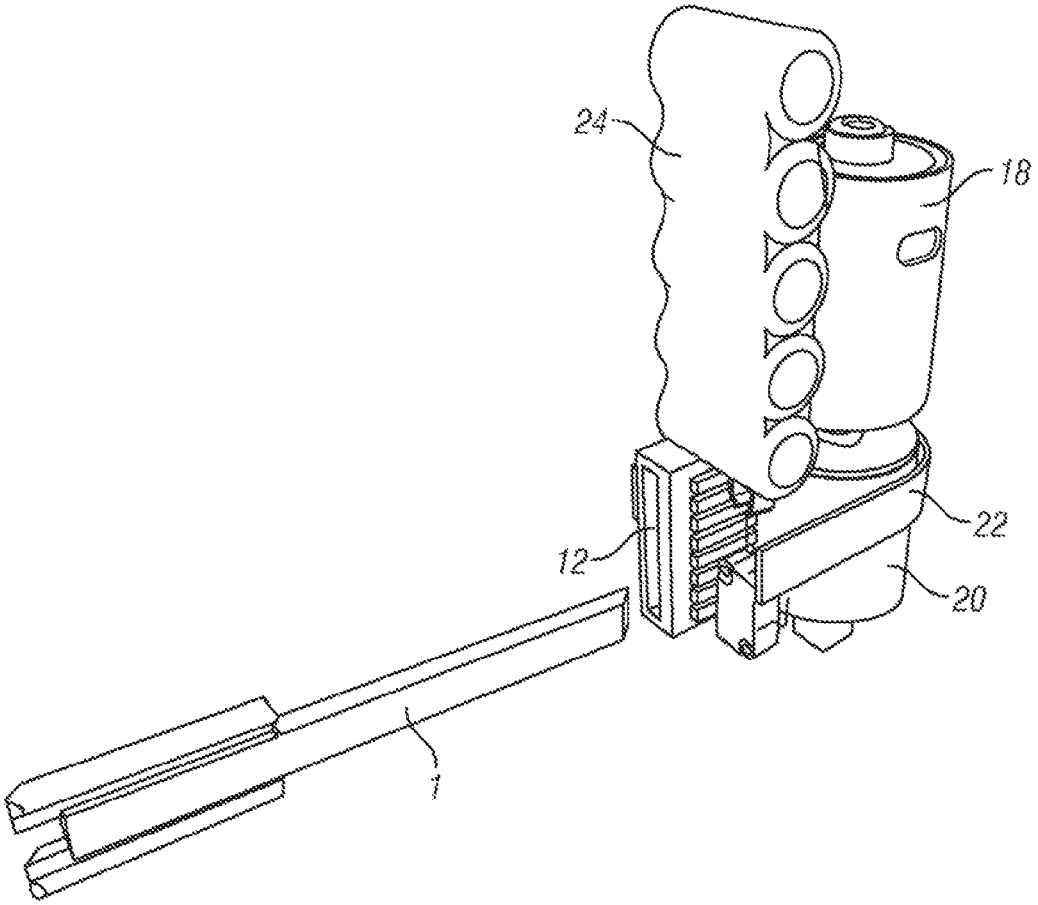
FIG. 4 is a perspective view of the inner components of the portable sharpening apparatus of the present invention including a tool to be sharpened inserted into the sharpening apparatus.
Figure 5:
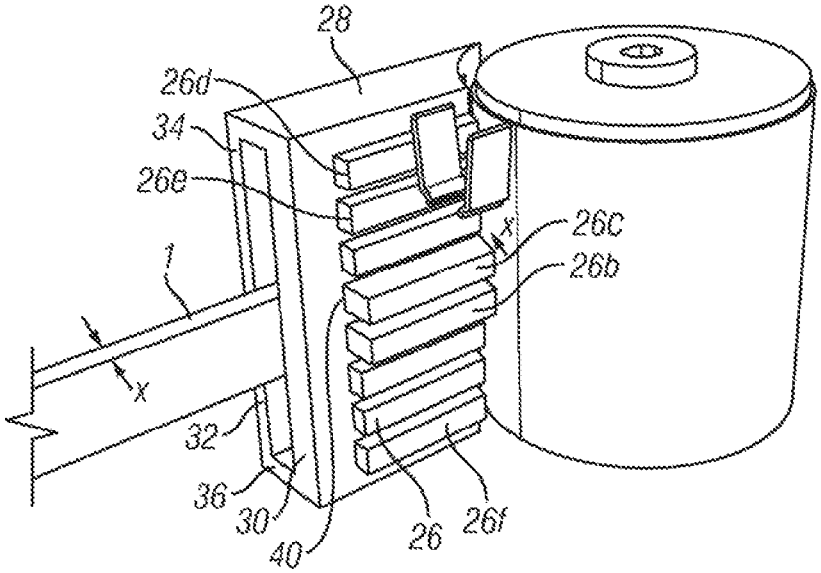
FIG. 5 is a view of the interior of the portable sharpening apparatus of FIG. 1*b;*

The internal features of the sharpening apparatus housed within body 10 will now be described in further detail with reference to FIG. 4 and FIG. 5. The sharpening apparatus comprises an abrasive drum 18, a motor 20 and gear box (not shown) The motor 20 is arranged in connection with the abrasive drum 18 by means of a belt drive 22. The motor 20 may be battery powered with battery pack 24 connected to the motor 20, as illustrated in FIG. 5. Alternatively, other sources of power, including a connection to mains power or lithium ion batteries from rechargeable sources could be considered for use in the apparatus.

A switch 23 or switch component is arranged to abut and engage with a mouth portion, here illustrated as the hatch 11 and opening 12. The switch 23 is brought into operative communication with the motor 20 and drive means by insertion of a tool to be sharpened, as described in further detail below.

A series of finger supports 26 are located at and through mouth 28 via in a number or corresponding slots 30. The mouth 28 acts as the receiving means for insertion of a tool to be sharpened, here, scraper 1. The opening 12 and the mouth 28 are sized so as to receive a scraper 1. The opening 12 and mouth entrance are generally rectangular in shape, although other shapes are possible.

The mouth 28 is delimited by a front wall 30, a rear wall 32, an upper wall 34, and a lower wall 36, the walls being substantially straight. The dimension of the opening between the upper wall 34 and the lower wall 36 and between the front wall 30 and the rear wall 32 is such that the mouth is sized slightly larger than the largest (breath dimension, y and width dimension, z) Elixair™ SkyScraper tool available, around a 0.04 m breath and around a 0.006 m width.

The distance between the scraper 1 and the upper wall 34 and between the scraper 1 and the lower wall 36 of the mouth is substantially uniform as the scraper is inserted into the mouth 28, i.e. the orientation direction is maintained.

The series of finger supports 26 are arranged such that each finger is located through slots 40 in the front wall 30 of the mouth 28. The slots 40 are arranged in a direction parallel to the direction of insertion of the tool into the mouth 28.

Each support 26 is located in a spaced relationship to the others in the series and such that each finger support 26 is spaced equidistant from its' neighbour. The finger supports 26 are fixedly connected to a portion of the apparatus housing and are sprung and biased towards the interior of the mouth. The effect is that the finger supports 26 are located partially inside and partially outside mouth 28. Each finger support is slideably moveable within the corresponding slot 40 and is moveable independently from its neighbours in a direction perpendicular to the axis of rotation of the drum 18. In a start or 'at rest' position, a portion of each finger support 26 is obscured within the mouth 28 and is not visible in the embodiment illustrated in FIG. 4.

In FIG. 5 finger support 26*b* and finger support 26*c* are shown in an operative 'scraping' position and moved further outside the mouth portion 28 than the similar finger supports 26*d*, 26*e*, 26*f* etc. Thus finger supports 26*b* and 26*c* stand 'proud' and have been displaced from the start orientation and position to a position further outside the mouth portion. The change in position is equal to the width of the inserted scraper 1. The width of the scraper 1 is here denoted as x. The outward displacement of the finger supports 26 from the mouth 28 causes finger support 26*b* and finger supports 26*c* to impinge on and activate a switch 23 and mechanism. The switch may comprise a switch plate and the switch plate or switch are arranged in connection with drive means, motor 20, for driving the abrasive drum 18.

It can be envisaged that use of, and insertion into mouth 28 with a scraper having different dimensions b and w to scraper 1 of the illustrated embodiment in FIG. 1*a* and FIG. 5, could cause a different number of finger supports 26 to be displaced from the mouth portion 28 and by a different displacement measurement, amount x. For example, a thicker scraper having depth w', where w' is greater than w would displace finger supports 26*b* and 26*c* by an amount x', where x' is substantially equal to w' and greater than x. A broader, wider scraper having breath b', where b' is greater than b could displace one or more additional finger supports 26*a* located adjacent finger support 26*b* and finger support 26*c*.

It is envisaged that finger supports 26 and mouth portion 28 may be integrated into one or two plastic moulded parts. Such moulded parts as described comprise a flexible and not fixidly rigid geometry or geometrical structure. The structure enables the parts to move by sliding or engaging the mouth 28 and body 10 to move or spring back into the appropriate rest or start position without necessarily requiring separate spring components or an assembly of components each moving relative to each other. It is anticipated that the supporting means illustrated in FIG. 5 could be made using separate discreet components or a single moulded structure. A resilient biasing means (not shown) may be used to provide a spring force for biasing supporting fingers 26 into a rest position and against which the finger supports are moved into the extended or displaced position. The biasing means may be a leaf spring. The return spring force exerted on the finger support 26 acts on the finger support 26 so as to cause the finger support 26 to be returned to its rest position once the scraper 1 is removed from the mouth.

The components of the mouth 28 and body 10 may be partially integrated or be grouped and moulded so as to comprise a separate sub-assembly. Means for holding the components in position and in the correct orientation relative to one another is provided. Fixing means are provided in any of a number of known ways, for example, mechanically, by fixings such as screws or push fits, by use of glue or adhesive, by heat treatment or by welding together.

Figure 7:
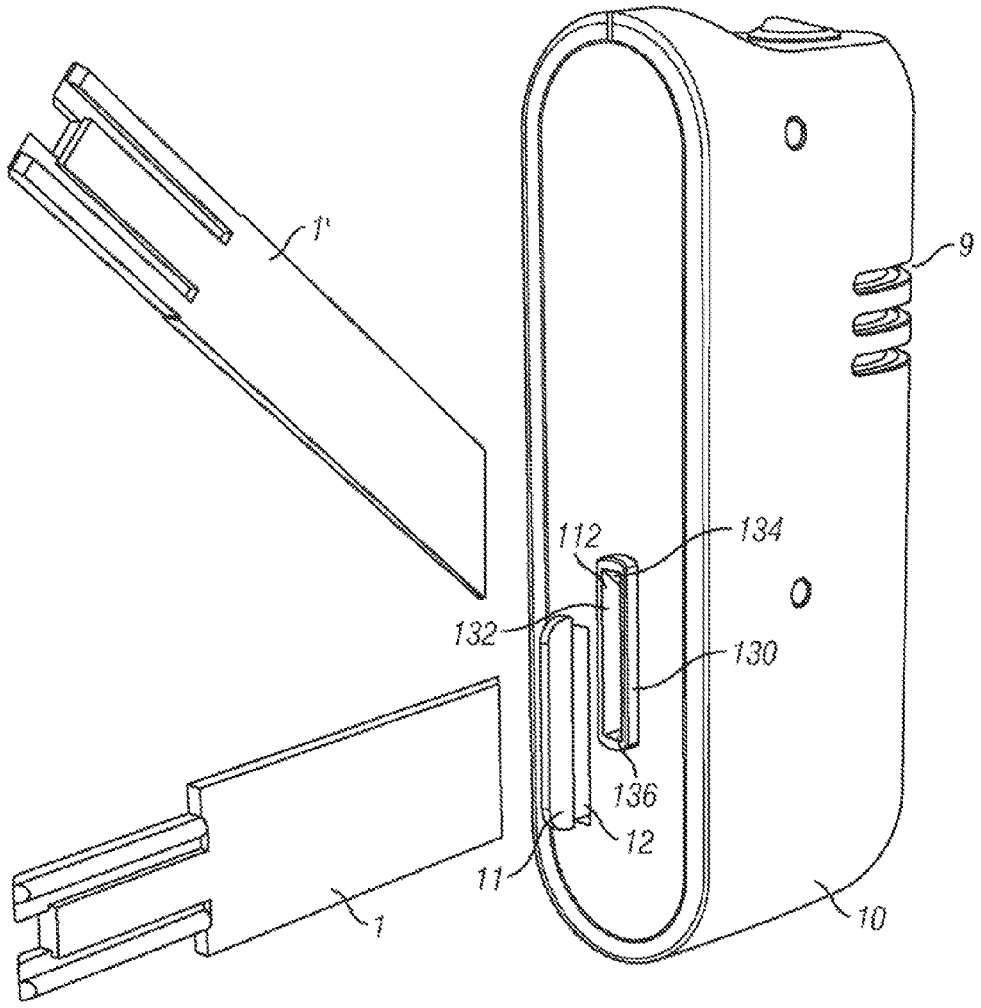
FIG. 7 is a perspective view of a tool to be sharpened inserted into an alternative embodiment of the portable sharpening apparatus.
Figure 8:
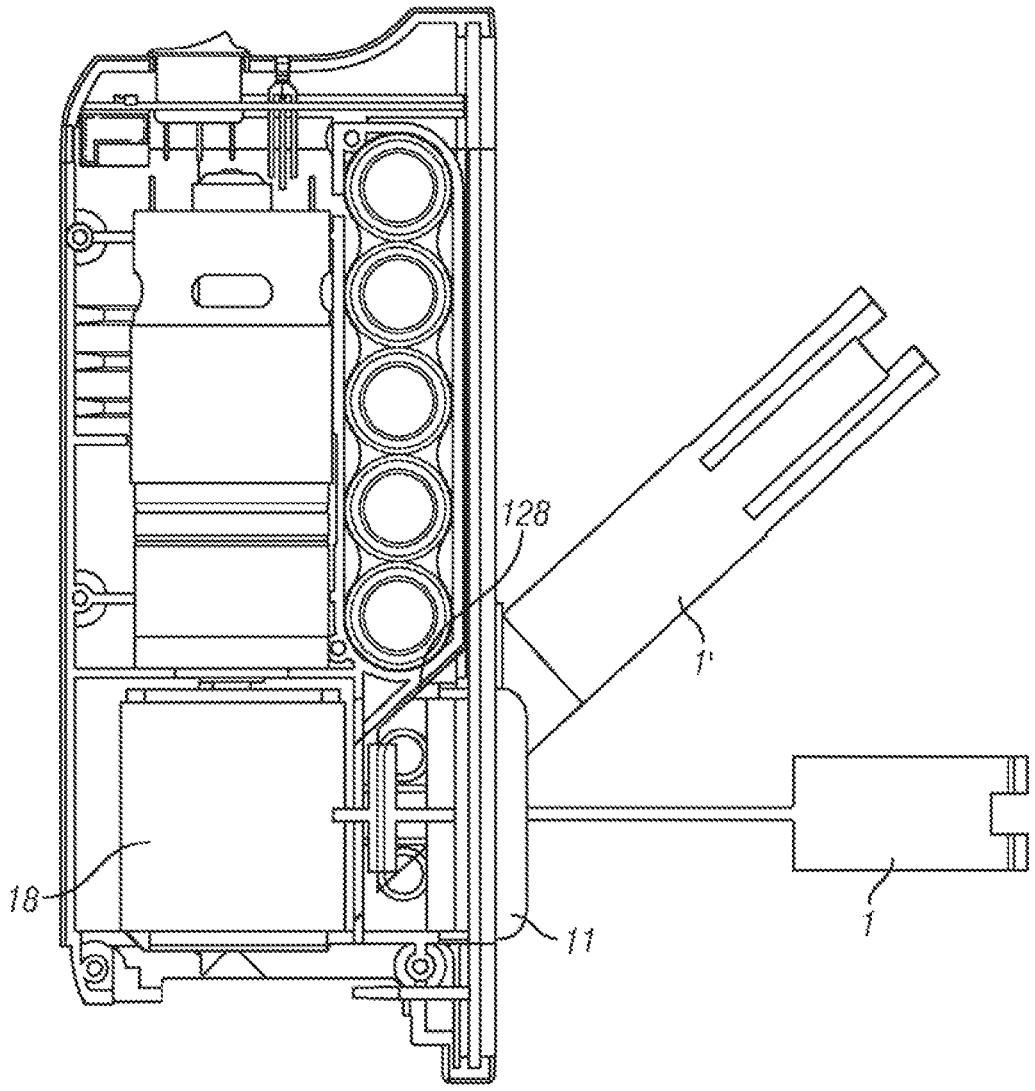
FIG. 8 is a cut away view of an alternative embodiment of the portable sharpening apparatus of the present invention.

In an alternative embodiment a second mouth 128 is provided as illustrated in FIG. 7 and FIG. 8. The opening 12 and mouth entrance are generally rectangular in shape, although other shapes are possible. The second embodiment is similar in construction to the first embodiment and will be described with like reference numerals corresponding to like components.

The mouth 128 is delimited by a front wall 130, a rear wall 132, an upper wall 134, and a lower wall 136, the walls being substantially straight. The dimension of the opening between the upper wall 134 and the lower wall 136 and between the front wall 130 and the rear wall 132 is such that the mouth is sized slightly larger than the largest (breath dimension, y and width dimension, z) Elixair™ SkyScraper tool available, around a 0.04 m breath and around a 0.006 m width.

The mouth 128 is rectangular in shape and may be provided alone on the portable sharpening apparatus or in addition to the mouth 28.

The upper wall 134 and the lower wall 136 of mouth 128 are arranged in parallel orientation to each other but angled at around 45 degrees to the plane perpendicular to the axis of rotation of the drum 18. The mouth 128 acts to introduce a tool to be sharpened at an angle that is not perpendicular to the axis of rotation.

The distance between the scraper 1' and the upper wall 134 and between the scraper 1' and the lower wall 136 of the mouth is substantially uniform as the scraper 1' is inserted into the mouth 128, i.e. the orientation direction is maintained. One or more finger supports 26 are provided in a manner similar to that described above for the mouth 28. In this way the tool to be sharpened, scraper 1' is supported and guided towards drum 18 such that the face of the tool to be edged and surfaced (a cutting face) is orientated obliquely to the axis of rotation of the cutting drum, as illustrated in FIGS. 7 and 8. The cutting face of scraper 1' meets the drum 18 on a centreline so that the grinding action effected results in a flat ground surface.

Figure 9:
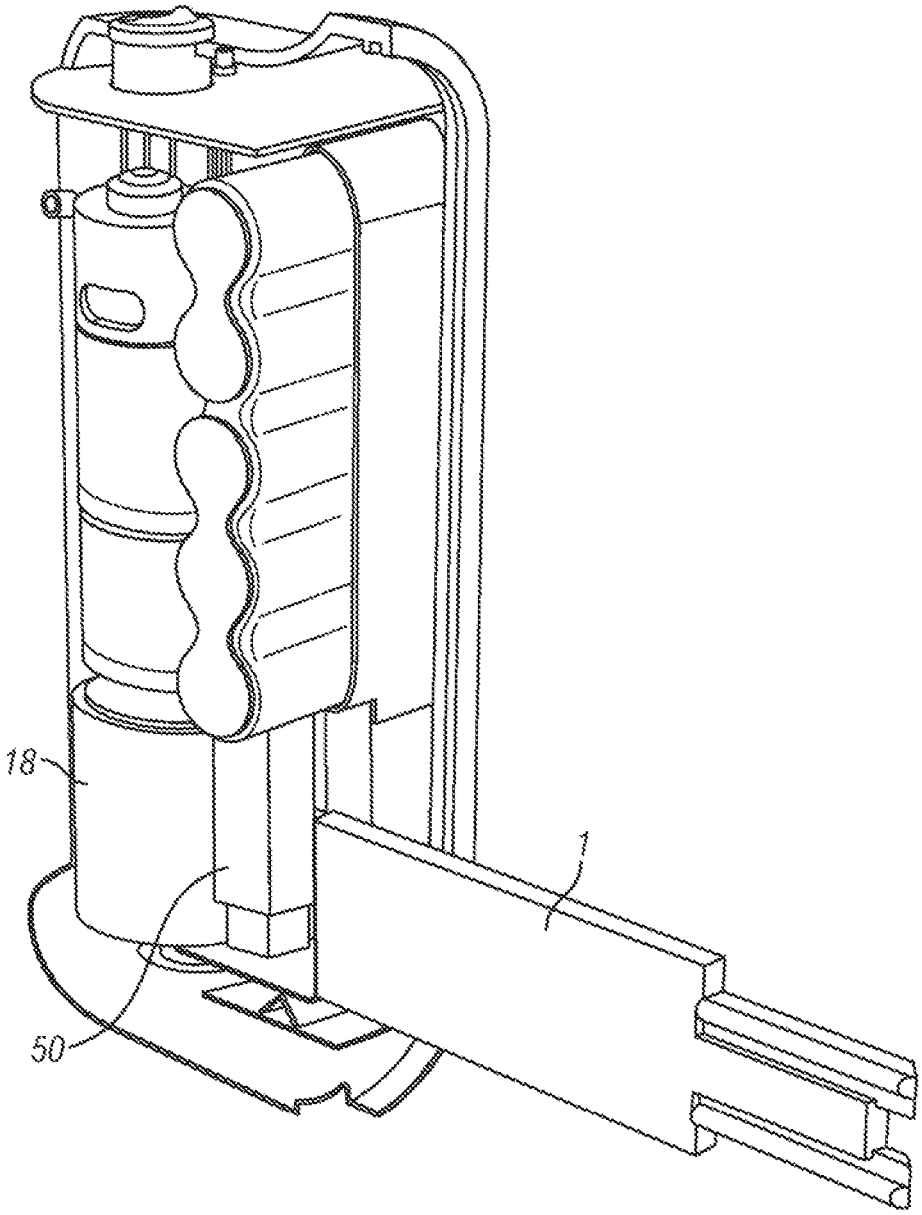
FIG. 9 is a cut away view of a portion of the portable sharpening apparatus of the present invention showing the tool to be sharpened and an access gate in a first position.

In an alternative embodiment an alternative switch operation is provided and the internal features of the sharpening apparatus with the alternative switch will now be described in further detail with reference to FIG. 9 and FIG. 10. The sharpening apparatus comprises an access gate 50 connected to the main body 10 by means of a hinge or other fixing with an angular orientation. The gate 50 has an axis of rotation and is arranged to lie with its axis of rotation parallel to the axis of rotation of the abrasive drum 18. The gate 50 is located upstream of the drum and in the mouth 28, 128 and pathway of the scraper 1, 1' so that the lower face of the scraper 1, 1' will impinge on the gate 50 before the abrasive drum. A portion of the gate 50 may comprise a step to act as a physical barrier (a pokoye fixing) to the insertion of a scraper 1, 1' in an incorrect orientation, insertion of the wrong end for sharpening, for example. This avoids waste of battery charge and operator time. A proximity switch 23 is located in the region of the gate 50 and the movement of the gate 50 in a downwards direction by the scraper 1, 1' activates the switch, in turn the switch 23 is brought into operative communication with the motor 20 and drive means. The gate 50 is shown in a first position in FIG. 9 and in a second position, pushed aside by scraper 1, in FIG. 10.

Figure 6:
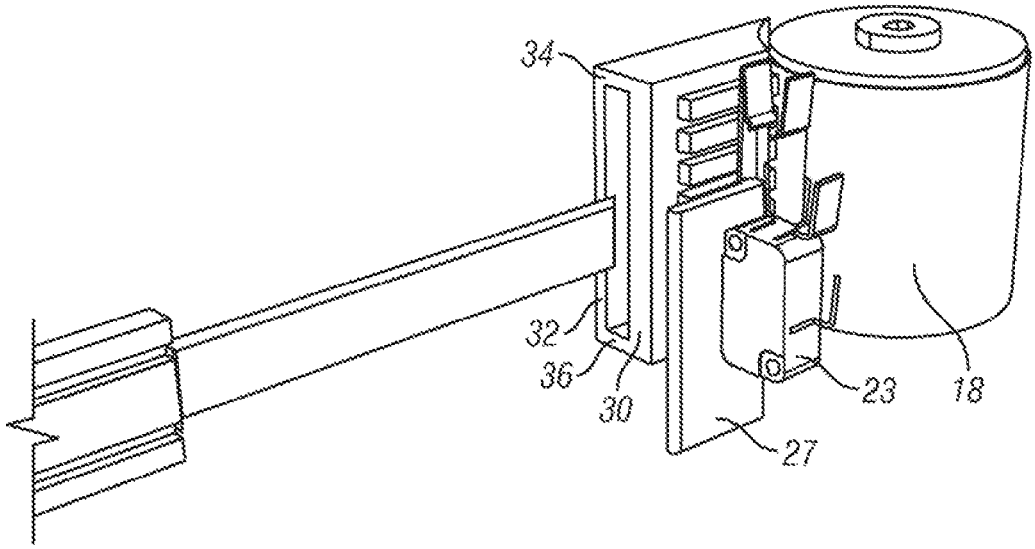
FIG. 6 is a view in detail of the interior of the portable sharpening apparatus of the present invention.

In operation, when a user is ready to use the portable sharpening apparatus of either or both of the first and second embodiments the apparatus is activated by switching the button 15 from an 'off' setting to an cony or 'standby'. A tool to be sharpened, here illustrated as scraper 1 and scraper 1' in FIGS. 6 and 7 is inserted into and through hatch 11 and mouth opening 12, and opening 112 by a user. As sharpener 1 approaches mouth portion 28, 128 it will be guided and orientated in the correct alignment position at drum 18 by finger supports 26. A medium sized scraper 1, 1' would displace around two to three supporting fingers 26 from a position partially within the mouth portion 28, 128. It is envisaged that a smaller scraper will displace fewer supporting fingers 26 and a larger scraper would displace and cause the movement of a greater number of supporting fingers. The number of supporting fingers 26 that are lifted or displaced is determined by the dimensions of the scraper 1, 1' that is inserted and the angular orientation of the scraper within the mouth 28, 128.

The supporting action of the fingers 26 against the scrapper 1 will grip and guide the scrapper 1. For example, in mouth 28 if the scraper 1 is inserted perpendicular to the axis of rotation of the drum 18, the sides of the supporting fingers 26 that have not been displaced by the scraper 1 will tend to maintain the perpendicular direction and orientation of the scraper. Alternatively, if the scraper 1 is inserted into mouth 28 at an angle away from perpendicular to the axis of rotation of the drum 18, then the sides of the supporting fingers 26 which have not been displaced or lifted will tend to act to correct the angle of approach of the scraper 1 back towards the perpendicular. As the scraper 1 is urged towards the perpendicular line, the supporting fingers 26 which have been lifted or displaced will tend to be removed from the face of the scraper 1 and return to their 'at rest' under a returning spring force, the action of return of those supporting fingers 26 will reinforce the orientation of the scraper 1 to be perpendicular to the axis of rotation of the drum 18.

It is not anticipated that the supporting fingers 26 will provide a significant clamping force on the scraper 1, 1'.

The displacement of any of the finger supports 26 will impinge on a portion of a switch 23. The switch activates motor 20 and drive means capable of rotating and driving the abrasive drum 18.

In an alternative the impinging action of the scraper 1, 1' on the gate 50 will release a proximity switch. The switch activates motor 20 and drive means capable of rotating and driving the abrasive drum 18.

The gate 50 displaced by the scraper 1, 1', activates switch 23 and the drum 18. As the scraper 1, 1' is brought into contact with the drum the friction force applied by the drum 18 to the scraper 1, 1' acts in a direction on the scraper 1, 1' and the gate 50 so as to urge the scraper 1, 1' further into operation with the drum 18 and the gate 50 into a 'switch on' position. In this way the likelihood of the motor 20 switching off during the sharpening operation is reduced.

Figure 10:
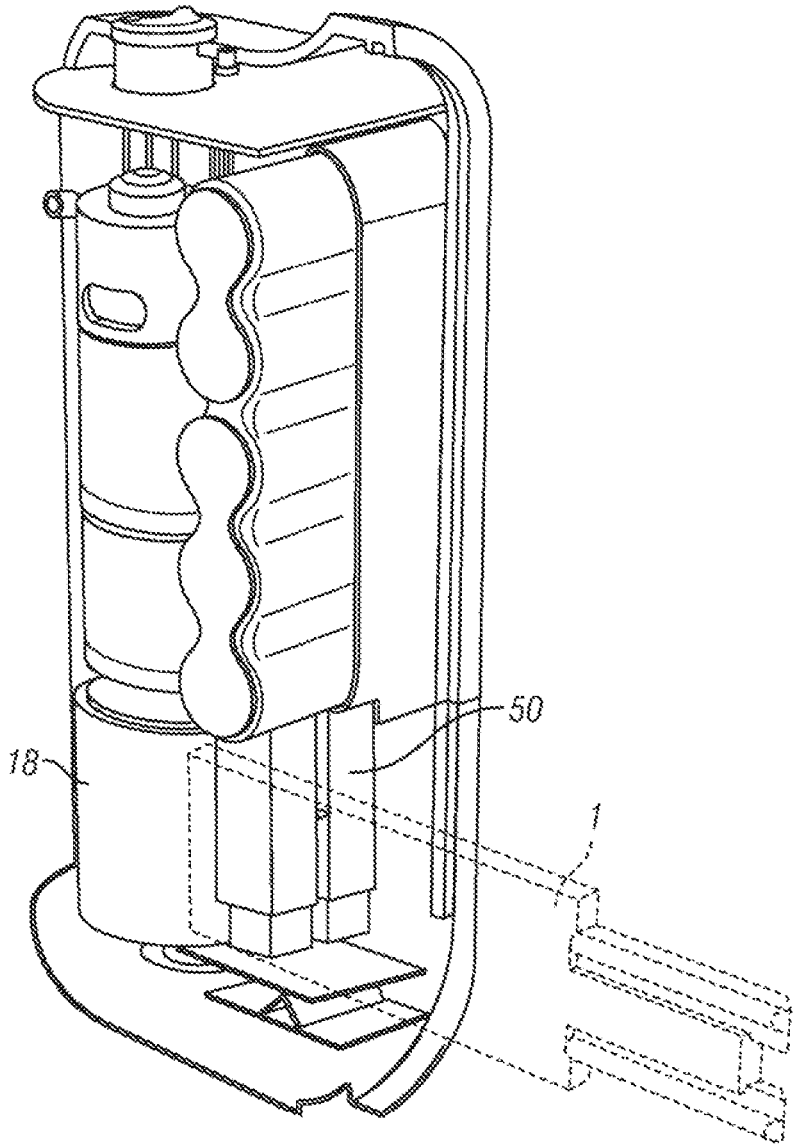
FIG. 10 is a cut away view of the portion of the portable sharpening apparatus of FIG. 9 showing the tool to be sharpened and an access gate in a second position.

The scraper 1, 1' is then moved beyond gate 50 towards the drum 18, as illustrated in FIG. 10. Scraper 1 is shown in relief in order to show the position of the gate 50 moved and pushed aside by the insertion of the scraper 1. Next the scraper 1, 1' is moved into a position of abutment with the rotating drum 18 while the blunted end (lower face) is sharpened against the drum 18.

In this manner the scraper 1, initially located and loosely held within the sharpening apparatus by the user, is held and secured within the sharpening apparatus at the correct position and orientation at the drum 18 for accurate and complete sharpening. The scraper 1, 1' is held within the apparatus by the user for a suitable length of time to re-edge the end 3.

Various modifications may be made to the described embodiment without departing from the scope of the present invention. There may be a different number of mouth portions or the mouth portion may be arranged differently. Other options for abrasive units, abrasive drums or motor drive units are envisaged, for example, the sharpening operation has been described with reference to an abrasive drum however, an alternative abrasive member may be used. The abrasive may be provided on other types of surface such as a grinding disk or a reciprocating grinding surface, other alternatives for sharpening include a cutting blade or knife. The sharpening schemes and the examples of abrasive members could be used alone or in combination. There may be more than one switch and any number of finger supporting means may be envisaged.

Alternative forms of construction of the body of the sharpening apparatus may be considered, such as a circular or cylindrical shape. The mouth and the surfacing member or abrasive portion of the portable sharpening apparatus may be provided inside or outside of a housing containing the motor, power supply (such as batteries) and electrical components. The illustrated arrangement of a sealable cover and protected opening could be provided by a single or multiple element cover of rigid or flexible construction and may be operated by sliding, pivoting, or flexing open in order to reveal the opening.

Versions of the sharpening apparatus particularly suitable for use by left or right handed users may be provided. Other means of connecting the sharpening apparatus to a user can be envisaged such as a body strap or back sling.

The invention claimed is:

1. A portable sharpening apparatus comprising:

a body portion;

a cavity formed in the body portion for receiving an object to be sharpened;

a rotatable abrasive drum capable of sharpening and having an axis of rotation, the abrasive drum located in the body portion;

a motor arranged to drive the abrasive drum;

a mouth communicating with the abrasive drum and arranged in the body portion so as to direct an object to be sharpened towards the abrasive drum; and an access gate located upstream of the abrasive drum and arranged in communication with the motor such that, when in use, the abrasive drum is driven by the motor in response to a displacement of the access gate by the introduction of an object to be sharpened into the mouth, wherein the mouth has a supporting means for locating an object to be sharpened at the abrasive drum, the supporting means being such that, when in use, an object to be sharpened is orientated along an axis substantially perpendicular to the axis of rotation of the abrasive drum.

2. A portable sharpening apparatus according to claim 1, wherein the displacement of the access gate is arranged to engage a switch, the switch being capable of activating the motor to drive the abrasive drum.

3. A portable sharpening apparatus according to claim 2, wherein the switch comprises activation means arranged to activate the motor to drive the abrasive drum in response to the presence in the cavity of an object to be sharpened and further comprises deactivation means arranged to deactivate the motor in response to the absence in the cavity of an object to be sharpened.

4. A portable sharpening apparatus comprising:

a body portion;

a cavity formed in the body portion for receiving an object having a face to be sharpened;

a surfacing member capable of sharpening and having an axis of operation, the surfacing member located in the body portion;

a motor arranged to drive the surfacing member at the axis of operation;

a mouth communicating with the surfacing member and arranged in the body portion so as to direct an object to be sharpened towards the surfacing member; and a sealable opening in the casing arranged in communication with the cavity, wherein the mouth comprises a supporting means for locating an object to be sharpened at the surfacing member.

5. A portable sharpening apparatus according to claim 4, wherein the sealable opening comprises a slideable cover arranged to cover the opening and biased across the opening.

6. A portable sharpening apparatus according to claim 5, wherein the slideable cover includes resilient means for biasing the cover into a closed position.

7. A portable sharpening comprising:

a body portion;

a cavity formed in the body portion for receiving an object having a face to be sharpened;

a surfacing member capable of sharpening and having an axis of operation, the surfacing member located in the body portion;

a motor arranged to drive the surfacing member at the axis of operation; and a mouth communicating with the surfacing member and arranged in the body portion so as to direct an object to be sharpened towards the surfacing member, wherein the mouth comprises a supporting means for locating an object to be sharpened at the surfacing member, wherein the supporting means comprises a plurality of teeth arranged in communication with the mouth and wherein the supporting means includes resilient means for biasing at least one tooth of the plurality of teeth towards an inner portion of the mouth, such that in use the at least one tooth is urged away from the inner portion of the mouth by introduction in the mouth of an object to be sharpened, wherein the plurality of teeth is located through at least one of the group of a front wall, a rear wall, an upper wall and a lower wall of the mouth.

8. A portable sharpening apparatus according to claim 7, wherein in use the at least one tooth or teeth is urged away from a first position in the inner portion of the mouth towards a second position in the cavity outside the walls of the mouth by introduction in the mouth of an object to be sharpened.

9. A portable sharpening apparatus according to claim 8, wherein the tooth or teeth in the second position in the cavity are arranged to engage a switch, the switch being capable of activating the motor to drive the abrasive drum.

* * * * *